US007145542B2

(12) United States Patent
Kasai

(10) Patent No.: US 7,145,542 B2
(45) Date of Patent: Dec. 5, 2006

(54) SIGNAL TRANSMISSION DEVICE, SIGNAL TRANSMISSION METHOD, ELECTRONIC DEVICE, AND ELECTRONIC EQUIPMENT

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 480 days.

(21) Appl. No.: 10/387,516

(22) Filed: Mar. 14, 2003

(65) Prior Publication Data

US 2003/0174108 A1 Sep. 18, 2003

(30) Foreign Application Priority Data

Mar. 18, 2002 (JP) ..... 2002-073864

(51) Int. Cl.
*G09G 3/36* (2006.01)

(52) U.S. Cl. ..... 345/98; 345/87; 345/100

(58) Field of Classification Search ..... 345/98, 345/99, 100, 87, 94
See application file for complete search history.

(56) References Cited

U.S. PATENT DOCUMENTS

| | | | | |
|---|---|---|---|---|
| 5,959,601 | A | 9/1999 | Ho et al. | 345/98 |
| 6,104,364 | A * | 8/2000 | Hayashi | 345/87 |
| 6,806,854 | B1 * | 10/2004 | Cairns et al. | 345/87 |
| 6,825,836 | B1 * | 11/2004 | Stewart et al. | 345/212 |
| 6,989,810 | B1 * | 1/2006 | Morita | 345/98 |
| 2001/0010512 | A1 * | 8/2001 | Azami | 345/100 |
| 2001/0048408 | A1 | 12/2001 | Koyama et al. | |
| 2003/0006978 | A1 | 1/2003 | Fujiyoshi | |
| 2003/0043132 | A1 | 3/2003 | Nakamura | |
| 2003/0107537 | A1 | 6/2003 | Ochi et al. | |

FOREIGN PATENT DOCUMENTS

| | | |
|---|---|---|
| EP | 0 923 067 A1 | 6/1999 |
| EP | 1 132 882 A2 | 9/2001 |
| JP | A-04-330489 | 11/1992 |
| JP | A-05-204339 | 8/1993 |
| JP | A-06-095067 | 4/1994 |
| JP | A-07-056543 | 3/1995 |
| JP | A-09-016128 | 1/1997 |
| JP | A-2001-075524 | 3/2001 |
| JP | A-2001-249650 | 9/2001 |
| JP | A-2001-290457 | 10/2001 |
| JP | A-2003-077663 | 3/2003 |
| WO | WO 02/077957 A1 | 3/2002 |

* cited by examiner

*Primary Examiner*—Kent Chang
(74) *Attorney, Agent, or Firm*—Oliff & Berridge, PLC

(57) ABSTRACT

A signal transmission device has a parallel/serial conversion section which converts a plurality of first parallel signals into at least one line of serial signals, the first parallel signals being output in parallel and in synchronization; and one or more serial transmission lines which transmit the serial signals converted by the parallel/serial conversion section.

54 Claims, 11 Drawing Sheets

SIGNAL TRANSMISSION DEVICE, SIGNAL TRANSMISSION METHOD, ELECTRONIC DEVICE, AND ELECTRONIC EQUIPMENT

Japanese Patent Application No. 2002-073864 filed on Mar. 18, 2002, is hereby incorporated by reference in its entirety.

BACKGROUND OF THE INVENTION

The present invention relates to a signal transmission device, a signal transmission method, an electronic device, and electronic equipment.

As conventional signal transmission methods, a serial method and a parallel method can be given. The serial method is used for transmission and reception of signals between a driver circuit and a display panel in a large liquid crystal display device, for example. According to the serial method, the number of transmission lines can be decreased since the signals are transmitted in series to transmission lines. However, since high-speed drive is necessary in the serial method, power consumption is increased and circuit operations may become unstable due to occurrence of noise. The parallel method is used for transmission and reception of signals between a driver circuit and a display panel in a small liquid crystal display device, for example. According to the parallel method, since the signals are transmitted in parallel to a plurality of transmission lines, high-speed drive is not necessary, whereby power consumption can be reduced. Moreover, circuit operations are stabilized since occurrence of noise is reduced. However, the parallel method has a problem in which the transmission lines must be provided corresponding to the number of signals.

BRIEF SUMMARY OF THE INVENTION

A signal transmission device according to an aspect of the present invention comprises:

a parallel/serial conversion section which converts a plurality of first parallel signals into at least one line of serial signals, the first parallel signals being output in parallel and in synchronization; and one or more serial transmission lines which transmit the serial signals converted by the parallel/serial conversion section.

An electronic device according to another aspect of the present invention comprises:

the above signal transmission device; and a functional section provided to the second component, wherein the functional section is operated according to the first parallel signals.

Electronic equipment according to a further aspect of the present invention comprises:

the above electronic device; and an operating section of the electronic device.

A signal transmission method according to a still further aspect of the present invention comprises:

(a) outputting a plurality of first parallel signals in parallel and in synchronization from a parallel signal output section, and transmitting the first parallel signals to a plurality of first parallel transmission lines;

(b) converting the first parallel signals into at least one line of serial signals by a parallel/serial conversion section, and transmitting the serial signals to one or more serial transmission lines; and (c) converting the serial signals into a plurality of second parallel signals by a serial/parallel conversion section, and transmitting the second parallel signals to a plurality of second parallel transmission lines, wherein the parallel signal output section, the first parallel transmission lines, and the parallel/serial conversion section are provided to a first component, wherein the serial/parallel conversion section and the second parallel transmission lines are provided to a second component, and wherein each of the serial transmission lines has a first transmission section provided to the first Component and a second transmission section provided to the second component, the first transmission section and the second transmission section being connected.

DETAILED DESCRIPTION OF THE EMBODIMENT

Figure 1:
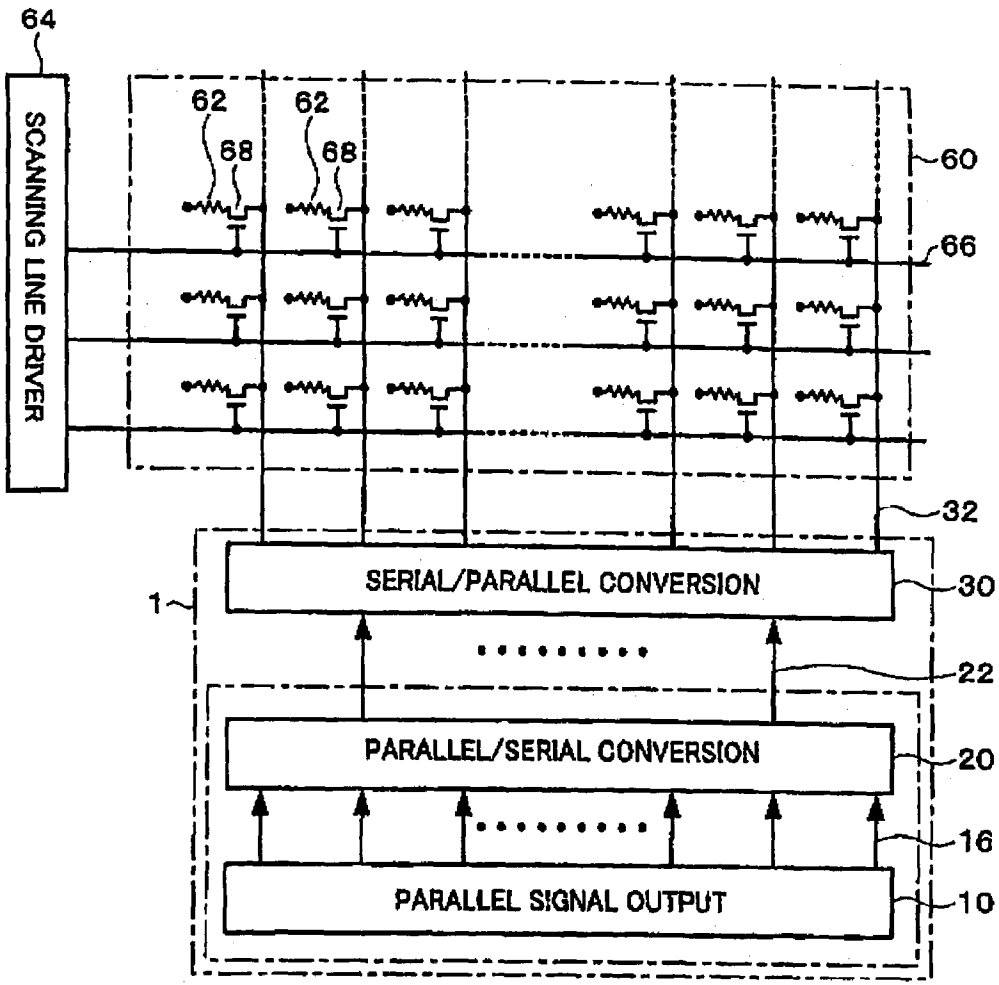
FIG. 1 shows a circuit of an electronic device according to a first embodiment of the present invention.

Embodiments of the present invention may decrease the number of transmission lines while maintaining low-speed drive (low power consumption) when transmitting signals, specifically, to enable stable low-speed operations as well as a decrease in the number of interconnects and terminals for connection sections necessary for connecting parts.

(1) A signal transmission device according to one embodiment of the present invention comprises:

a parallel/serial conversion section which converts a plurality of first parallel signals into at least one line of serial signals, the first parallel signals being output in parallel and in synchronization; and one or more serial transmission lines which transmit the serial signals converted by the parallel/serial conversion section.

According to the signal transmission device of the present invention, since the first parallel signals are converted into at least one line of serial signals, the number of serial transmission lines can be decreased.

(2) in this signal transmission device, the serial signals may be output as current signals.

(3) This signal transmission device may further comprise a parallel signal output section which outputs the first parallel signals.

(4) This signal transmission device may further comprise a plurality of first parallel transmission lines which transmit the first parallel signals.

(5) In this signal transmission device, the parallel signal output section, the first parallel transmission lines, and the parallel/serial conversion section may be provided to a first component.

(6) This signal transmission device may further comprise a serial/parallel conversion section which converts the serial signals into a plurality of second parallel signals.

(7) This signal transmission device may further comprise a plurality of second parallel transmission lines which transmit the second parallel signals (8) In this signal transmission device, the serial/parallel conversion section and the second parallel transmission lines may be provided to a second component.

(9) In this signal transmission device, each of the serial transmission lines may have a first transmission section provided to the first component and a second transmission section provided to the second component, the first transmission section and the second transmission section being connected.

According to the signal transmission device having all the features described in (1) to (9), the first and second parallel signals are transmitted by the first and second parallel transmission lines. Therefore, since the signals are transmitted in parallel, low-speed drive may be sufficient, whereby power consumption can be reduced and unstable operations due to noise and the like can be prevented. Moreover, since the first parallel signals are converted into the serial signals, the number of serial transmission lines is smaller than the number of first parallel transmission lines. Therefore, the number of transmission lines can be decreased in comparison with the case where the signals are transmitted in parallel between the first and second components. As a result, the pitch of the serial transmission lines can be increased. Moreover, since the number of connection sections of the first and second transmission sections which are elements of the serial transmission lines can be decreased, positioning of the first and second transmission lines is facilitated, whereby occurrence of mispositioning can be reduced.

(10) In this signal transmission device, the first parallel signals may be transmitted in parallel through n lines, the number of the first parallel transmission lines may be n, the serial signals may be successively transmitted in series in a unit of m per line, the serial signals may be transmitted in series separately through n/m lines, the number of the serial transmission lines may be n/m, and the number of the second parallel transmission lines may be n,

(11) In this signal transmission device, the first parallel signals may be transmitted in parallel through n lines, the number of the first parallel transmission lines may be n, the serial signals may be transmitted in series separately through x lines, the number of the serial transmission lines may be x, and the number of the second parallel transmission lines may be n.

(12) In this signal transmission device, the first parallel signals may be analog signals.

(13) In this signal transmission device, the parallel/serial conversion section may include a sampling switch which switches connection between one group of transmission lines among the first parallel transmission lines and one of the serial transmission lines.

(14) In this signal transmission device, a plurality of the sampling switches may be provided, and each of the sampling switches may be provided to a path between one transmission line of the one group of the first transmission lines and one of the serial transmission lines.

(15) In this signal transmission device, the parallel/serial conversion section further may include a sampling switch control section which controls the sampling switches so that the sampling switches are successively turned on.

(16) In this signal transmission device, the parallel/serial conversion section may further include a plurality of sampling switching transmission lines which connect the sampling switch control section with control terminals of the sampling switches, and the sampling switch control section may successively transmit sampling switching signals to the sampling switching transmission lines.

(17) In this signal transmission device, the number of the sampling switching transmission lines may be m.

(18) In this signal transmission device, the number of the sampling switching transmission lines may be n/x.

(19) In this signal transmission device, the serial/parallel conversion section may include a plurality of storage sections, each of the storage sections storing information corresponding to one of the serial signals.

(20) In this signal transmission device, each of the storage sections may include a storage medium which stores the information, a write switch for writing the information in the storage medium, and a read switch for reading the information from the storage medium.

(21) In this signal transmission device, the serial/parallel conversion section may further include a write switch control section which controls the write switches in one group of storage sections among the storage sections so that the write switches are successively turned on.

(22) In this signal transmission device, the serial/parallel conversion section may further include a plurality of write switching transmission lines which connect the write switch control section with control terminals of the write switches, and the write switch control section may successively transmit write switching signals to the write switching transmission lines.

(23) In this signal transmission device, the number of the write switching transmission lines may be m.

(24) In this signal transmission device, the number of the write switching transmission lines may be n/x.

(25) In this signal transmission device, the storage medium may be a capacitor and bold charges as the information.

(26) In this signal transmission device, each of the second parallel signals may be a current signal.

(27) In this signal transmission device, each of the storage sections may include first and second transistors, each of the first and second transistors may have first, second, and third terminals, current flowing between the first and second terminals may be controlled by voltage applied between the first and third terminals, the first terminal of the first transistor and the first terminal of the second transistor may be connected, and the third terminal of the first transistor and the third terminal of the second transistor may be connected, the second and third terminals of the first transistor may be connected, one of the serial transmission lines may be connected with the second terminal of the first transistor, one of the second parallel transmission lines may be connected with the second terminal of the second transistor, and the capacitor may be connected between the third terminal and the first terminal.

(28) In this signal transmission device, the write switch may perform on/off operations of first and second paths, the first path may be provided between the second terminal of the first transistor and one of the serial transmission lines, and the second path may be a path which branches from a path between the first path and the second terminal of the first transistor and may reach the third terminal.

(29) In this signal transmission device, the first and second transistors may be field effect transistors, the first and second terminals may be source and drain terminals, and the third terminals may be gate terminals.

(30) In this signal transmission device, a gain of the first transistor may be equal to a gain of the second transistor in at least one of the storage sections, and a signal input to the at least one storage section may be equal in size to a signal output from the at least one storage section.

(31) In this signal transmission device.

a gain of the first transistor may differ from a gain of the second transistor in at least one of the storage sections, and a signal input to the at least one storage section may differ in size from a signal output from the at least one storage section.

(32) In this signal transmission device, the serial signals may be output as voltage signals, and each of the second parallel signals may be a voltage signal.

(33) In this signal transmission device, the capacitor may have a first terminal connected with a path which connects one of the serial transmission lines with one of the second parallel transmission lines, and a second terminal connected with a constant potential, the write switch maybe provided to a path between the first terminal and one of the serial transmission lines, and the read switch may be provided to a path between the first terminal and one of the second parallel transmission lines.

(34) This signal transmission device may further comprise a buffer connected between the first terminal and the read switch.

(35) An electronic device according to another embodiment of the present invention comprises:

the above signal transmission device; and a functional section provided to the second component, wherein the functional section is operated according to the first parallel signals.

(36) In this electronic device, the functional section may be a display section, and the second parallel transmission lines may be data lines.

(37) In this electronic device, the functional section may include a plurality of luminous sections.

(38) In this electronic device, the luminous sections may emit light of a plurality of colors, each of the luminous sections emitting light of one of the colors, one of the luminous sections of one color may differ in luminous efficiency from another of the luminous sections of another color, each of the storage sections may be provided corresponding to the luminous sections of respective colors, and a gain ratio of the first and second transistors in each of the storage sections may be set corresponding to the luminous efficiency.

(39) In this electronic device, the gain ratio of the first and second transistors may be one in one of the storage sections corresponding to one of the luminous sections of one of the colors, and the gain ratio of the first and second transistors may be set to other than one in the other storage sections corresponding to the luminous sections of the other two or more colors.

(40) In this electronic device, the luminous sections may emit light of a plurality of colors, each of the luminous sections emitting light of one of the colors, one of the luminous sections of one color may differ in luminous efficiency from another of the luminous sections of another color, the buffer may be provided corresponding to each of the luminous sections of respective colors, and an energy amplification factor of the buffer may be set corresponding to the luminous efficiency.

(41) In this electronic device, a liquid crystal may be provided to the functional section.

(42) Electronic equipment according to a further embodiment of the present invention comprises:

the above electronic device; and an operating section of the electronic device.

(43) A signal transmission method according to a still further embodiment of the present invention comprises:

(a) outputting a plurality of first parallel signals in parallel and in synchronization from a parallel signal output section, and transmitting the first parallel signals to a plurality of first parallel transmission lines;

(b) converting the first parallel signals into at least one line of serial signals by a parallel/serial conversion section, and transmitting the serial signals to one or more serial transmission lines; and (c) converting the serial signals into a plurality of second parallel signals by a serial/parallel conversion section, and transmitting the second parallel signals to a plurality of second parallel transmission lines, wherein the parallel signal output section, the first parallel transmission lines, and the parallel/serial conversion section are provided to a first component, wherein the serial/parallel conversion section and the second parallel transmission lines are provided to a second component, and wherein each of the serial transmission lines has a first transmission section provided to the first component and a second transmission section provided to the second component, the first transmission section and the second transmission section being connected.

In the signal transmission method of the present invention, the first and second parallel signals are transmitted by the first and second parallel transmission lines. Therefore, since the signals are transmitted in parallel, low-speed drive is sufficient, whereby power consumption can be reduced and operations are stabilized. Moreover, since the first parallel signals are converted into the serial signals, the number of serial transmission lines is smaller than the number of first parallel transmission lines. Therefore, the number of transmission lines can be decreased in comparison with the case where the signals are transmitted in parallel between the first and second components. As a result, the pitch of the serial transmission lines can be increased. Moreover, since the number of connection sections of the first and second transmission sections which are elements of the serial transmission lines can be decreased, positioning of the first and second transmission lines is facilitated, whereby occurrence of mispositioning can be reduced.

(44) In this signal transmission method, in the step (b) connection between one group of transmission lines among the first parallel transmission lines and one of the serial transmission lines may be switched by a sampling switch.

(45) In this signal transmission method, a plurality of the sampling switches may be provided, each of the sampling switches may be provided to a path between one transmission line of the one group of the first transmission lines and one of the serial transmission lines, and in the step (b), the sampling switches may be controlled by a sampling switch control section so that the sampling switches are successively turned on.

(46) In this signal transmission method, the parallel/serial conversion section may further include a plurality of sampling switching transmission lines which connect the sampling switch control section with control terminals of the sampling switches, and in the step (b), sampling switching signals may be successively transmitted to the sampling switching transmission lines by the sampling switch control section.

(47) In this signal transmission method, the serial/parallel conversion section may include a plurality of storage sections, and in the step (c), information corresponding to one of the serial signals may be stored in each of the storage sections.

(48) In this signal transmission method, each of the storage sections may include a storage medium which stores the information, a write switch for writing the information in the storage medium, and a read switch for reading the information from the storage medium, and in the step (c), the write switches in one group of storage sections among the storage sections maybe controlled by a write switch control section so that the write switches are successively turned on.

(49) In this signal transmission method, the serial/parallel conversion section may further include a plurality of write switching transmission lines which connect the write switch control section with control terminals of the write switches, and in the step (c), write switching signals may successively transmitted to the write switching transmission lines by the write switch control section.

(50) In this signal transmission method, the storage medium may be a capacitor, each of the storage sections may include first and second transistors, and in the step (c), current may be caused to flow through one of the second parallel transmission lines by Storing charges corresponding to a control voltage of current flowing through the first transistor in the capacitor, and controlling the second transistor by voltage corresponding to the charges.

(51) In this signal transmission method, a gain of the first transistor may be equal to a gain of the second transistor in at least one of the storage sections, and current which is equal in size to current input to the at least one storage section may be output in the step (c).

(52) in this signal transmission method, a gain of the first transistor may differ from a gain of the second transistor in at least one of the storage sections, and current which differs in size from current input to the at least one storage section may be output in the step (c).

(53) In this signal transmission method, the storage medium may be a capacitor, and in the step (c), charges may be stored in the capacitor and voltage corresponding to the charges may be applied to one of the second parallel transmission lines.

The embodiments of the present invention are described below with reference to the drawings.

First Embodiment

Figure 2:
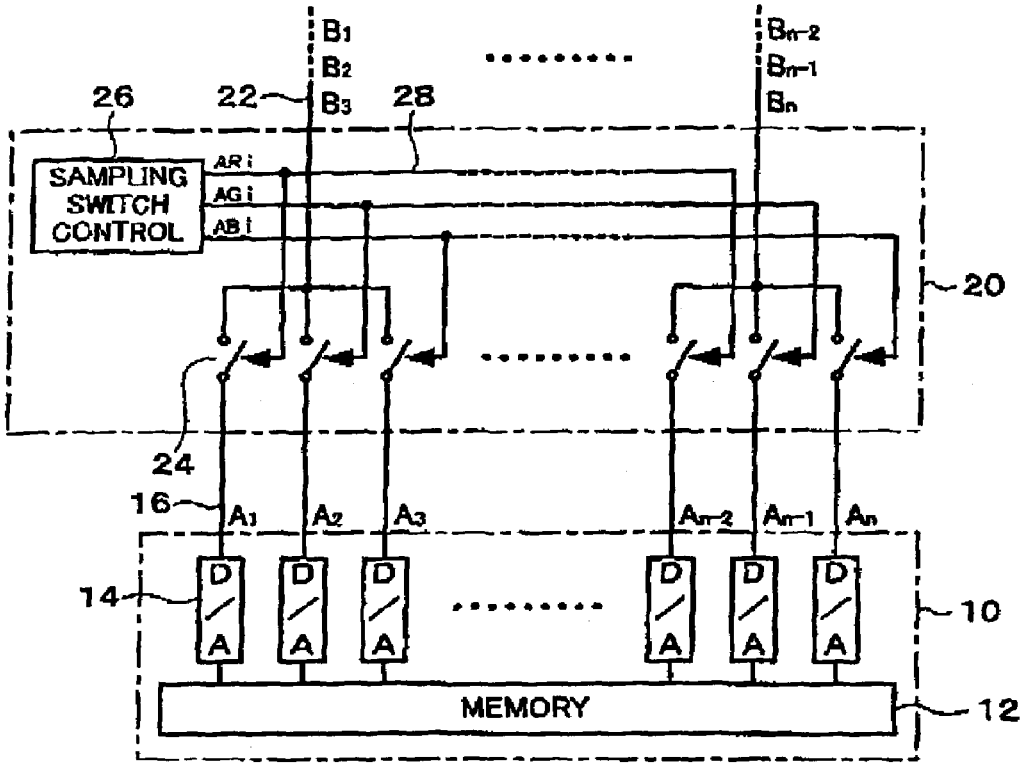
FIG. 2 illustrates details of a circuit of a signal transmission device.
Figure 3:
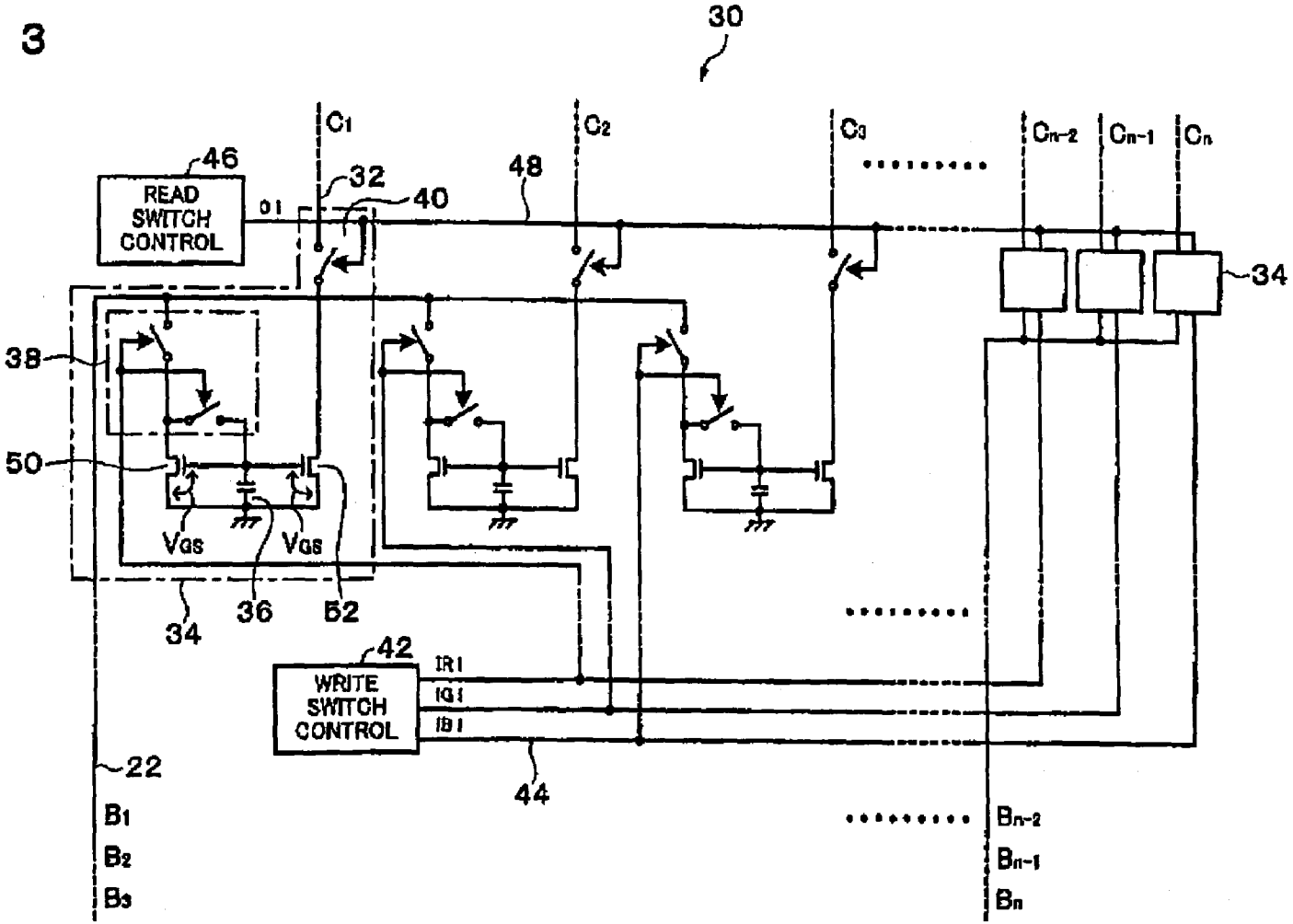
FIG. 3 illustrates details of a circuit of a signal transmission device.

FIG. 1 shows a circuit of an electronic device according to a first embodiment of the present invention. The electronic device includes a signal transmission device 1. FIGS. 2 and 3 illustrate details of a circuit of the signal transmission device.

The signal transmission device 1 includes a parallel signal output section 10. As shown in FIG. 2. the parallel signal output section 10 outputs first parallel signals $A_1, \ldots,$ and $A_n$. The first parallel signals $A_1, \ldots,$ and $A_n$are output in synchronization. The number of first parallel signals $A_1, \ldots.$ and $A_n$ is n (the number the same as the number of signals supplied to pixels in one horizontal scanning period, for example). In the present embodiment, the first parallel signals $A_1, \ldots,$ and $An_n$ are analog signals (current signals in the present embodiment; the first parallel signals may be voltage signals). However, the present invention does not preclude the case where the first parallel signals are digital signals.

The parallel signal output section 10 may include a memory (frame memory, for example) 12. In the case where the electronic device is a display, signals for displaying one or more screens are stored in the memory 12. Digital signals are stored in the memory 12. The digital signals may be converted into analog signals by D/A converters 14. In the present embodiment, signals (analog signals) output from the D/A converters 14 are parallel/serial converted. As a modification example, parallel/serial converted digital signals may be input to the D/A converters. In more detail, digital signals output in parallel from the memory 12 may be parallel/serial converted by applying the present invention, and the digital signals output in series may be D/A converted. This enables the circuit area occupied by the D/A converters to be decreased. In a color display, the first parallel signals $A_1, \ldots,$ and $A_n$ may be signals input to sub pixels of a plurality of colors (R, G, and B, for example) which make up one pixel. However. the combination of the signals to be parallel/serial converted by applying the present invention is not limited to R, G, and B and may optionally be selected. The first parallel signals $A_1, \ldots,$ and $A_n$ are transmitted by a plurality of first parallel transmission lines (interconnects, for example) 16. The number of first parallel transmission lines 16 is n.

The signal transmission device 1 includes a parallel/serial conversion section 20. The parallel/serial conversion section 20 converts the first parallel signals $A_1, \ldots$, and $A_n$ into at least one line of serial signals $B_1, \ldots$, and $B_n$. In the present embodiment, the serial signals $B_1, \ldots$, and $B_n$ are current signals. However, the serial signals $B_1, \ldots$, and $B_n$ may be voltage signals. The number of the serial signals $B_1, \ldots$, and $B_n$ per line is m. In a color display, one line of the serial signals ($B_1$, $B_2$, and $B_3$, for example) may be the first parallel signals $A_1, \ldots$, and $A_n$, corresponding to a plurality of sub pixels (three sub pixels consisting of red (R), green (G), and blue (B). for example) which make up one pixel among the first parallel signals $A_1, \ldots$, and $A_n$.

As a modification example, two of the first parallel signals ($A_1$ and $A_2$, for example) transmitted by the adjacent two first parallel transmission lines 16 may be converted into one line of serial signals ($B_1$ and $B_2$, for example). The number of inputs of the first parallel signals converted into the serial signals may be four or more. The first parallel transmission lines 16 which transmit the first parallel signals may not be located adjacent to each other.

The number of lines of the serial signals $B_1, \ldots$, and $B_n$ is n/m. The serial signals $B_1, \ldots$, and $B_n$ are transmitted by at least one serial transmission line (interconnect, for example) 22. The number of serial transmission lines 22 is n/m.

The parallel/serial conversion section 20 includes at least one sampling switch 24. At least one sampling switch 24 switches connection between one group of transmission lines among the first parallel transmission lines 16 (first parallel transmission lines 16 which transmit the first parallel signals $A_1$, $A_2$, and $A_3$ to be converted into one line of the serial signals $B_1$, $B_2$, and $B_3$, for example) and one of the serial transmission lines 22. In the case where a plurality of sampling switches 24 are provided, each of the sampling switches 24 is provided to a path between one transmission line among one group of the first parallel transmission lines 16 and one of the serial transmission lines 22.

The parallel/serial conversion section 20 includes a sampling switch control section 26. The sampling switch control section 26 controls the sampling switches 24 so that the sampling switches 24 are successively turned on. All the sampling switches 24 are not necessarily turned on. The sampling switch control section 26 and control terminals of the sampling switches 24 are connected by a plurality of sampling switching transmission lines 28. The number of sampling switching transmission lines 28 is m (the number of one line of the serial signals ($B_1$, $B_2$, and $B_3$, for example)). The sampling switch control section 26 successively transmits sampling switching signals $AR_i$, $AG_i$, and $AB_i$ to the sampling switching transmission lines 28. For example, when the sampling switching signal $AR_i$ is transmitted, the first parallel signal $A_1$ (R signal of the color display, for example) is transmitted to the serial transmission line 22 as the serial signal $B_1$. When the sampling switching signal $AG_i$ is transmitted, the first parallel signal $A_2$ (G signal of the color display, for example) is transmitted to the same serial transmission line 22 as the serial signal $B_2$. When the sampling switching signal $AB_i$, is transmitted, the first parallel signal $A_3$ (B signal of the color display, for example) is transmitted to the same serial transmission line 22 as the serial signal $B_3$.

The signal transmission device 1 includes a serial/parallel conversion section 30. As shown in FIG. 3, the serial/parallel conversion section 30 converts the serial signals $B_1, \ldots$, and $B_n$ into second parallel signals $C_1, \ldots$, and $C_n$. In the present embodiment, each of the second parallel signals $C_1, \ldots$, and $C_n$ is a current signal. The number of second parallel signals $C_1, \ldots$, and $C_n$ is n (the number the same as the number of the first parallel signals $A_1, \ldots$, and $A_n$) . The second parallel signals $C_1, \ldots$, and $C_n$ are transmitted by a plurality of second parallel transmission lines (interconnects, for example) 32. The number of second parallel transmission lines 32 is n (the number the same as the number of the first parallel transmission lines 16).

The serial/parallel conversion section 30 includes a plurality of storage sections 34. Each of the storage sections 34 stores information corresponding to one of the serial signals $B_1, \ldots$, and $B_n$. Each of the storage sections 34 includes a storage medium 36 which stores the information, a write switch 38 for writing the information in the storage medium 36, and a read switch 40 for reading the information from the storage medium 36. The storage medium 36 may be a capacitor and hold charges as the information.

The serial/parallel conversion section 30 includes a write switch control section 42 which controls the write switches 38 so that the write switches 38 are successively turned on in one group of the storage sections 34 (storage sections 34 which store the information corresponding to one line of the serial signals ($B_1$, $B_2$, and $B_3$, for example)) among the storage sections 34. The write switch control section 42 and control terminals of the write switches 38 are connected by a plurality of write switching transmission lines 44. The number of write switching transmission lines 44 is m (the number of one line of the serial signals ($B_1$, $B_2$, and $B_3$, for example)). The write switch control section 42 successively transmits write switching signals $IR_i$, $IG_i$, and $IB_i$ to the write switching transmission lines 44. For example, when the write switching signal $IR_i$ is transmitted, the serial signal $B_1$ (R signal of the color display, for example) is stored. When the write switching signal $IG_i$ is transmitted, the serial signal $B_2$ (G signal of the color display. for example) is stored. When the write switching signal $IB_i$ is transmitted, the serial signal $B_3$ (B signal of the color display, for example) is stored.

The serial/parallel conversion section 30 includes a read switch control section 46 which controls the read switches 40. The read switch control section 46 and control terminals of the read switches 40 are connected by a read switching transmission line 48. The read switch control section 46 transmits a read switching signal $O_i$ to the read switching transmission line 48. In the present embodiment, when the read switching signal $O_i$ is transmitted, the information stored in all the storage sections 34 is read at the same time. This allows the second parallel signals $C_1, \ldots$, and $C_n$ to be output.

Each of the storage sections 34 includes first and second transistors 50 and 52. Each of the first and second transistors 50 and 52 shown in FIG. 3 is a field effect transistor (MOS transistor, for example). However, the first and second transistors 50 and 52 may be bipolar transistors. Each of the first and second transistors 50 and 52 has first and second terminals (source and drain terminals) and a third terminal (gate terminal). Current flowing between the first and second terminals (source and drain terminals) is controlled by a voltage $V_{GS}$ applied between the first terminal (source terminal, for example) and the third terminal (gate terminal).

Each of the storage sections 34 has a current mirror circuit. The first terminals (source terminals, for example) and the third terminals (gate terminals) of the first and second transistors 50 and 52 are connected. The second terminal (drain terminal, for example) and the third terminal (gate terminal) of the first transistor 50 are connected. One of the serial transmission lines 22 is connected with the second terminal (drain terminal, for example) of the first transistor 50. One of the second parallel transmission lines 32 is connected with the second terminal (drain terminal, for example) of the second transistor 52. The capacitor as the storage medium 36 is connected between the third terminals (gate terminals) of the first and second transistors 50 and 52 and the first terminals (source terminals, for example) of the first and second transistors 50 and 52. The first terminals (source terminal, for example) of the first and second transistors 50 and 52 are connected with a constant potential (ground potential, for example).

In the case where the gain of the first transistor 50 is equal to the gain of the second transistor 52 in at least one of the storage sections 34, the signal input to the storage section 34 (serial signal $B_1$, for example) is equal in size to the signal output from the storage section 34 (second parallel signal $C_1$, for example). In the case where the gain of the first transistor 50 differs from the gain of the second transistor 52 in at least one of the storage sections 34, the signal input to the storage section 34 (serial signal $B_1$, for example) differs in size from the signal output from the storage section 34 (second parallel signal $C_1$, for example) In this case, all the serial signals $B_1, \ldots,$ and $B_n$ are set to have the same size and the sizes of the second parallel signals $C_1, \ldots,$ and $C_n$ can be allowed to differ from one another, if necessary.

The write switch 38 performs on/off operations of first and second paths. The first path is present between the second terminal (drain terminal, for example) of the first transistor 50 and one of the serial transmission lines 22. The second path is a path which branches from a path between the first path and the second terminal (drain terminal, for example) of the first transistor 50 and reaches the third terminals (gate terminals).

As shown in FIG. 1, the electronic device according to the present embodiment includes a functional section 60. The second parallel signals $C_1, \ldots,$ and $C_n$ are input to the functional section 60. The second parallel signals $C_1, \ldots,$ and $C_n$ are converted from the first parallel signals $A_1, \ldots,$ and $A_n$, as described above. Therefore, the functional section 60 is operated according to the first parallel signals $A_1, \ldots,$ and $A_n$, In the present embodiment, the functional section 60 is a display section, and the second parallel transmission lines 32 are data lines to the display section.

The functional section 60 includes a plurality of luminous sections 62. The luminous sections 62 emit light of a plurality of colors, and each of the luminous sections 62 may emit light of one of the colors. The luminous section 62 of at least one color may differ from the luminous sections 62 of the other colors in luminous efficiency (such as the ratio of luminous energy (brightness, for example) to input energy (current, for example)). Each of the luminous sections 62 is a sub pixel, and one pixel is made up of the sub pixels of a plurality of colors (RGB, for example). The arrangement of the luminous sections (sub pixels) 62 may be any of a vertical stripe arrangement, delta arrangement, and square arrangement. The second parallel signals $C_1, \ldots,$ and $C_n$, (current signals, for example) are input from the second parallel transmission lines (data lines) 32 to one group of the luminous sections 62 selected from the luminous sections 62 by a scanning line driver 64. A plurality of scanning lines 66 are connected with the scanning line driver 64. The second parallel signals $C_1, \ldots,$ and $C_n$ are input to one group of the luminous sections 62 connected with one group of select switches 68 which are turned on by a scanning signal input to one of the scanning lines 66.

Each of the storage sections 34 may be provided corresponding to the luminous sections 62 of each color. The gain ratio $(\beta_2/\beta_1)$ of the first and second transistors 50 and 52 may be set in each of the storage sections 34 corresponding to the luminous efficiency. For example, the gain ratio $(\beta_2/\beta_1)$ of the first and second transistors 50 and 52 may be one in the storage section 34 corresponding to the luminous section 62 of one color, and the gain ratio $(\beta_2/\beta_1)$ of the first and second transistors 50 and 52 may be set to other than one in the storage sections 34 corresponding to the luminous sections 62 of the other two or more colors.

Figure 4:
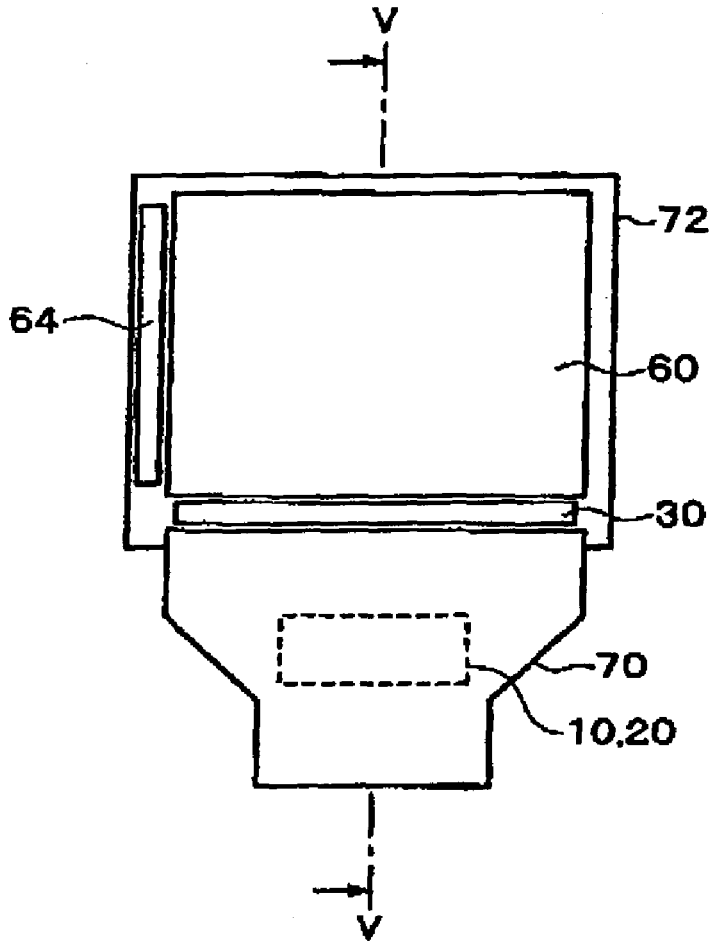
FIG. 4 illustrates a structure of the electronic device according to the first embodiment of the present invention.
Figure 5:
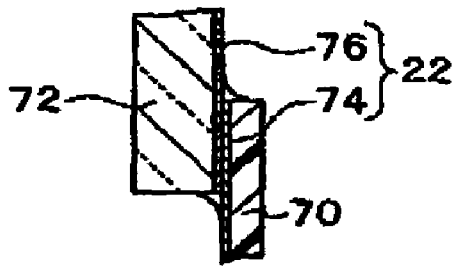
FIG. 5 is a partial enlarged cross-sectional view along the line V—V shown in FIG. 4.

FIG. 4 illustrates the structure of the electronic device according to the present embodiment. FIG. 5 is a partial enlarged cross-sectional view along the line V—V shown in FIG. 4. The electronic device includes first and second components 70 and 72. The first component 70 is a flexible substrate, for example. The parallel signal output section 10, the first parallel transmission lines 16, and the parallel/serial conversion section 20 are provided to the first component 70. The parallel signal output section 10, the first parallel transmission line 16, and the parallel/serial conversion section 20 may be included in a single integrated circuit chip (semiconductor chip, for example). The package form of the first component 70 equipped with the integrated circuit chip may be a TCP (Tape Carrier Package).

The serial/parallel conversion section 30 and the second parallel transmission lines 32 are provided to the second component 72. The second component 72 may be a rigid substrate such as a glass or plastic substrate and have optical transparency. The functional section 60 and the scanning line driver 64 may also be provided to the second component 72. In this case, the second component 72 may be referred to as a panel (display panel such as an organic EL (electroluminescent) panel). The serial/parallel conversion section 30, the second parallel transmission lines 32, and the scanning line driver 64 may be formed on the second component 72. In this case, low temperature polycrystalline silicon deposition technology may be applied.

As shown in FIG. 5, the first and second components 70 and 72 are secured. An adhesive may be used to secure the first and second components 70 and 72. Each of the serial transmission lines 22 has a first transmission section 74 provided to the first component 70 and a second transmission section 76 provided to the second component 72. The first and second transmission sections 74 and 76 are connected. In the case where the first and second transmission sections 74 and 76 are interconnects, the first and second transmission sections 74 and 76 are connected electrically. An anisotropic conductive material (such as an anisotropic conductive film or anisotropic conductive paste) or an insulating adhesive (paste) may be used for connection between the first and second transmission sections 74 and 76. In addition, a metal junction may be applied.

In the present embodiment, the first and second parallel signals $A_1, \ldots,$ and $A_n$, and $C_1, \ldots,$ and $C_n$ are transmitted by the first and second parallel transmission lines 16 and 32. According to this configuration, since the signals are transmitted in parallel, high-speed drive is not necessary, whereby power consumption can be reduced. Since the first parallel signals $A_1, \ldots,$ and $A_n$ are converted into the serial signals $B_1, \ldots,$ and $B_n$, the number of serial transmission lines 22 is smaller than the number of first parallel transmission lines 16. Therefore, the number of transmission lines can be decreased in comparison with the case where the signals are transmitted in parallel between the first and second components 70 and 72. As a result, the pitch of the serial transmission lines 22 can be increased. Moreover, since the number of connection sections of the first and second transmission sections 74 and 76 which are elements of the serial transmission lines 22 can be decreased, positioning of the first and second transmission lines 74 and 76 is facilitated, whereby occurrence of misalignment can be reduced.

The electronic device according to the present embodiment is a display device (display module, for example). An example in which the second component 72 having the functional section 60 is an organic EL (electroluminescent) panel is described below.

Figure 6:
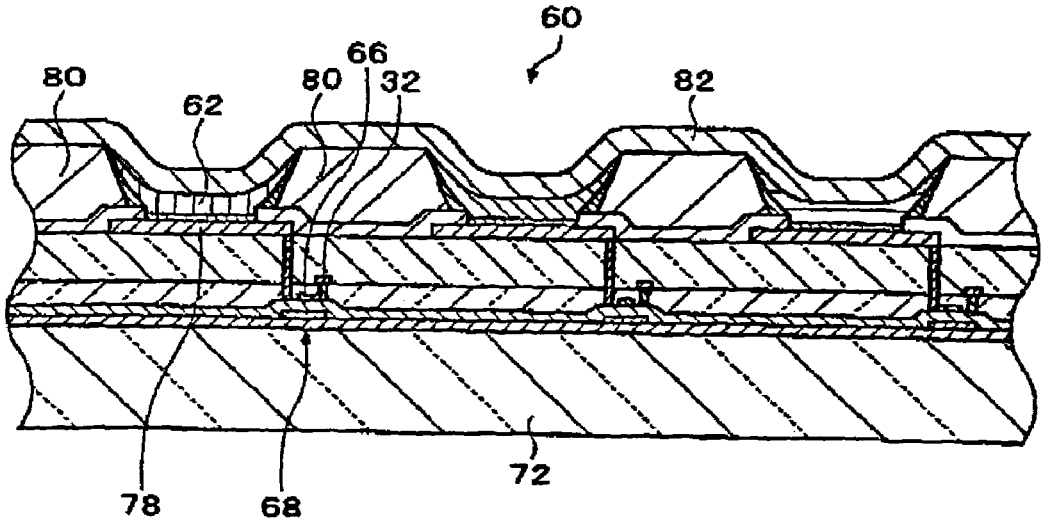
FIG. 6 illustrates details of a functional section.

FIG. 6 illustrates details of the functional section 60. The second component 72 is a substrate. The select switches 68 are formed on the second component 72. In the case where the select switches 68 are transistors, the scanning line 66 is connected with a gate terminal of the select switch 68, the second parallel transmission line 32 is connected with one of source and drain terminals, and a sub pixel electrode 78 is connected with the other of the source and drain terminals. The luminous section 62 is provided to the sub pixel electrode 78. The luminous section 62 has one of a luminous material of R, G, or B, and may further include a hole transport layer and an electron transport layer. The luminous material may be either a high-molecular-weight material or a low-molecular-weight material. The adjacent luminous sections 62 are divided by bank sections 80. A common electrode 82 is formed in the luminous section 62. In the case where light from the luminous section 62 is emitted from the second component 72, the second component 72 has optical transparency and the sub pixel electrodes 78 are formed of a material having optical transparency (ITO (Indium Tin oxide), for example).

Figure 7:
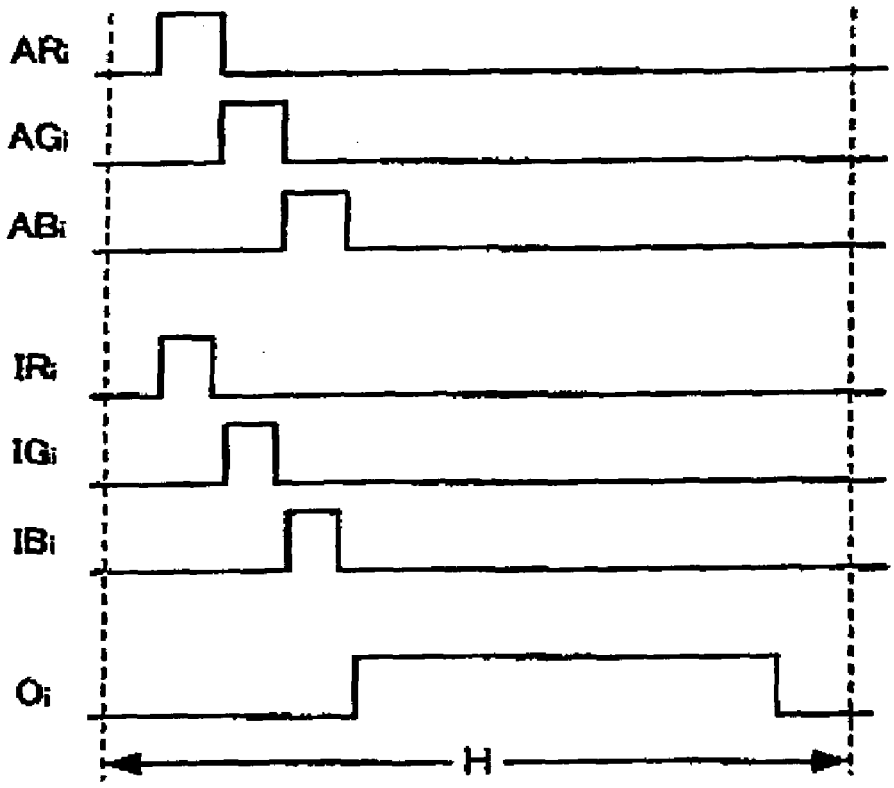
FIG. 7 illustrates operations of a signal transmission device according to the first embodiment of the present invention.

FIG. 7 illustrates the operations of the signal transmission device according to the present embodiment. In more detail, FIG. 7 shows timing of the control signal in a period 1H in which one of the scanning lines is selected.

As shown in FIG. 2, the first parallel signals $A_1, \ldots,$ and $A_n$, are output from the parallel signal output section 10 and transmitted to the first parallel transmission lines 16. All the first parallel signals $A_1, \ldots,$ and $A_n$ maybe transmitted at the same time.

The first parallel signals $A_1, \ldots,$ and $A_n$ transmitted to the first parallel transmission lines 16 are input to the parallel/serial conversion section 20. The first parallel signals $A_1, \ldots,$ and $A_n$ are converted into at least one line of the serial signals $B_1, \ldots,$ and $B_n$ by the parallel/serial conversion section 20 and transmitted to at least one serial transmission line 22. In the parallel/serial conversion section 20, connection between one group of transmission lines among the first parallel transmission lines 16 (first parallel transmission lines 16 which transmit the first parallel signals $A_1$, $A_2$, and $A_3$ to be converted into one line of the serial signals $B_1$, $B_2$, and $B_3$, for example) and one of the serial transmission lines 22 is switched by at least one sampling switch 24. The sampling switches 24 may be controlled by the sampling switch control section 26 so that the sampling switches 24 are successively turned on. In more detail, the sampling switching signals $AR_i$, $AG_i$, and $AB_i$ may be successively transmitted to the sampling switching transmission lines 28 by the sampling switch control section 26, as shown in FIG. 7.

The serial signals $B_1, \ldots,$ and $B_n$ transmitted to the serial transmission lines 22 are input to the serial/parallel conversion section 30. The serial signals $B_1, \ldots,$ and $B_n$ are converted into the second parallel signals $C_1, \ldots,$ and $C_n$ by the serial/parallel conversion section 30 and transmitted to the second parallel transmission lines 32. In the serial/parallel conversion section 30, the information corresponding to one of the serial signals $B_1, \ldots,$ and $B_n$ is stored in each of the storage sections 34. For example, the write switches 38 may be controlled by the write switch control section 42 so that the write switches 38 are successively turned on in one group of the storage sections 34 (storage sections 34 which store the information corresponding to one line of the serial signals ($B_1$, $B_2$, and $B_3$, for example)). In more detail, the write switching signals $IR_i$, $IG_i$, and $IB_i$ may be successively transmitted to the write switching transmission lines 44 by the write switch control section 42, as shown in FIG. 7. For example, the serial signal $B_1$ is output when the sampling switching signal $AR_i$ is input. Since the write switching signal $IR_i$ is input during a period in which the sampling switching signal $AR_i$ is input, information is stored in the corresponding storage section 34.

The operation of each of the storage sections 34 in the case where the serial signals $B_1, \ldots,$ and $B_n$ are current signals is described below. When the write switch 38 is turned on and the serial signal $B_1$ is input, for example, the read switch 40 is in an off state. In the first transistor 50, current flows between the first and second terminals (source and drain terminals) by the voltage $V_{GS}$ applied to the third terminal (gate terminal) based on the serial signal $B_1$. Charges corresponding to the voltage $V_{GS}$ are stored in the capacitor as the storage medium 36. The same operation is successively performed for the serial signals $B_2$ and $B_3$.

In the case where the serial signals $B_1, \ldots,$ and $B_n$ are divided into a plurality of lines, information corresponding to one of the serial signals may be stored at the same time in all the lines. For example, in the case where the serial signals $B_1, \ldots,$ and $B_n$ are divided into a unit of three signals per line, information for the serial signals $B_1$, $B_4$, $B_7, \ldots,$ and $B_{n-2}$ may be stored at the same time, information for the serial signals $B_2$, $B_5$, $B_8, \ldots,$ and $B_{n-1}$ may be stored at the same time, and information for the serial signals $B_3$, $B_6$, $B_9, \ldots,$ and $B_n$ may be stored at the same time.

When the information is stored in all the storage sections 34, the write switches 38 are turned off. When the read switches 40 are then turned on, the second parallel signals (current signals) $C_1, \ldots,$ and $C_n$ are output. In more detail, the second transistors 52 are controlled by the charges stored in the capacitors as the storage media 36, whereby the second parallel signals (current signals) $C_1, \ldots,$ and $C_n$ flow between the first and second terminals (source and drain terminals). The read switches 40 are controlled by the read switching signal $O_i$ from the read switch control section 46, as shown in FIG. 7.

If the gain of the first transistor 50 is equal to the gain of the second transistor 52, the voltages $V_{GS}$ applied to the third terminals (gate terminals) are the same. Therefore, the input signal is equal in size to the output signal. Specifically, the second parallel signal ($C_1$, for example) which is equal in size to the input serial signal ($B_1$, for example) can be output.

In the case where the gain of the first transistor 50 differs from the gain of the second transistor 52, a signal which differs in size from the input signal can be output. For example, in the case where the gain of the first transistor 50 and the gain of the second transistor 52 are respectively $\beta_1$ and $\beta_2$, an input signal $I_{in}$, and an output signal $I_{out}$ have a relation shown by $I_{out}=I_{in}\times(\beta_2/\beta_1)$. The second parallel signal ($C_3$, for example) which differs in size from the input serial signal ($B_3$, for example) can be output by utilizing this relation. In the case where luminous efficiency of the luminous material of one color (blue, for example) is poor in an organic EL display, the first and second transistors 50 and 52 are selected so that $1<\beta_2/\beta_1$ is balanced in the storage section 34 corresponding to the luminous section 62 of this color, whereby the amount of current (second parallel signal ($C_3$, for example)) greater than the amount of current (second parallel signals ($C_1$ and $C_2$, for example)) input to the luminous sections 62 of the other colors can be input to the blue luminous section 62. The color balance and the like can be adjusted by appropriately setting the gain coefficients of the transistors corresponding to R, G, and B.

The above-described operation allows the first parallel signals $A_1, \ldots,$ and $A_n$ to be input to the functional section 60 from the parallel signal output section 10 while being converted into the serial signal $B_1, \ldots, B_n$ and the second parallel signals $C_1, \ldots,$ and $C_n$ in the period 1H in which one of the scanning lines 66 is selected, as shown in FIG. 7.

In the present embodiment, since the first and second parallel signals $A_1, \ldots,$ and $A_n$ and $C_1, \ldots,$ and $C_n$ are transmitted in parallel, high speed drive is not necessary, whereby power consumption can be reduced and the circuit operations can be stabilized. Moreover, the number of connection terminals can be decreased by applying serial transmission in the connection area of the circuit formed on an independent part. Furthermore, the number of connection terminals, stability of operations, and a decrease in speed can be balanced by optimizing the degree of serialization and the degree of parallelization.

The brightness and the color balance can be adjusted by appropriately setting the gain ratio of the first and second transistors 50 and 52 (gain ratio of the current mirror circuit). For example, the color balance can be adjusted by appropriately setting the gain ratio of the current mirror circuits for R (red) G (green), and B (blue).

Second Embodiment

Figure 8:
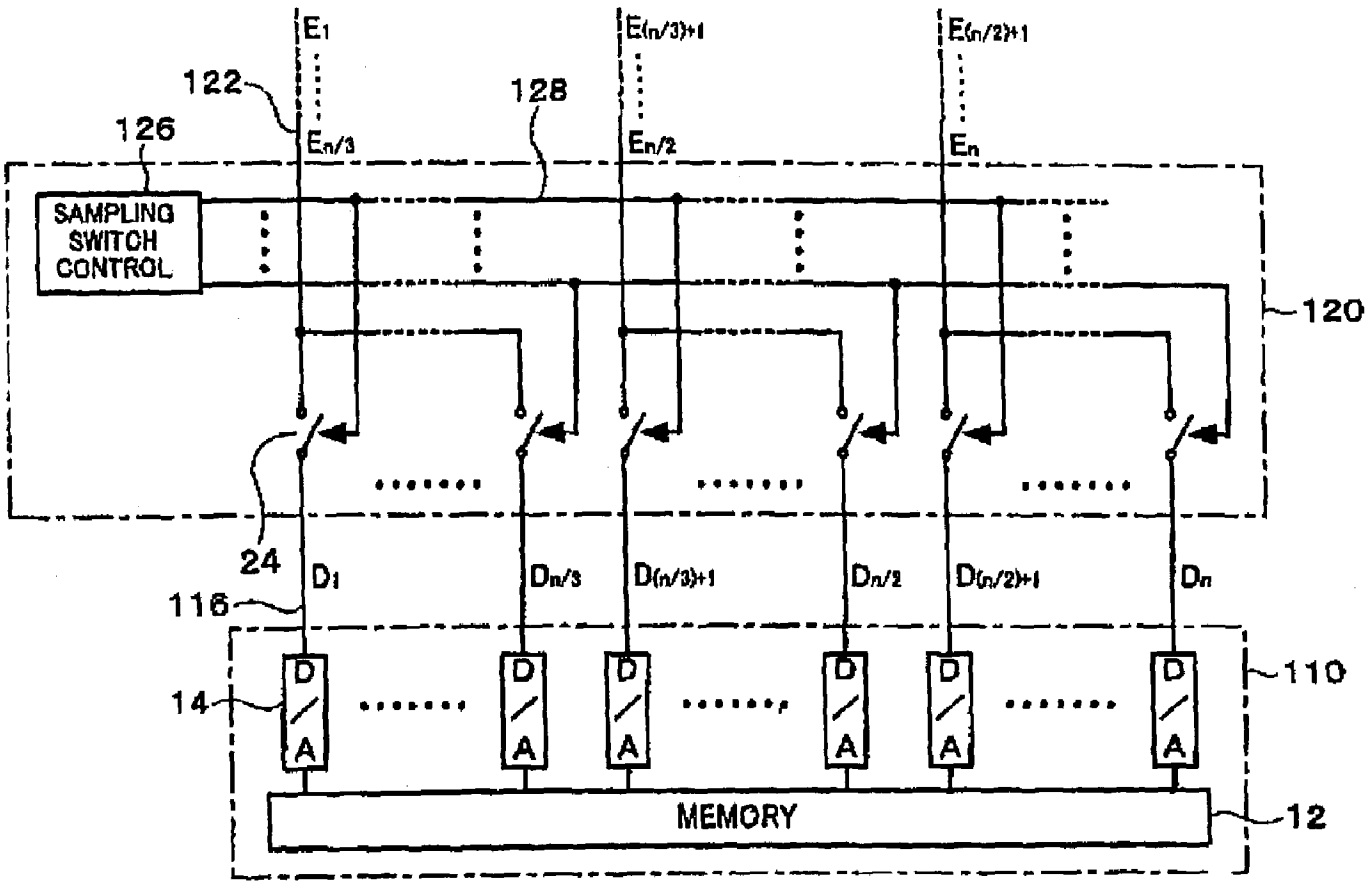
FIG. 8 shows a circuit of a signal transmission device according to a second embodiment of the present invention.
Figure 9:
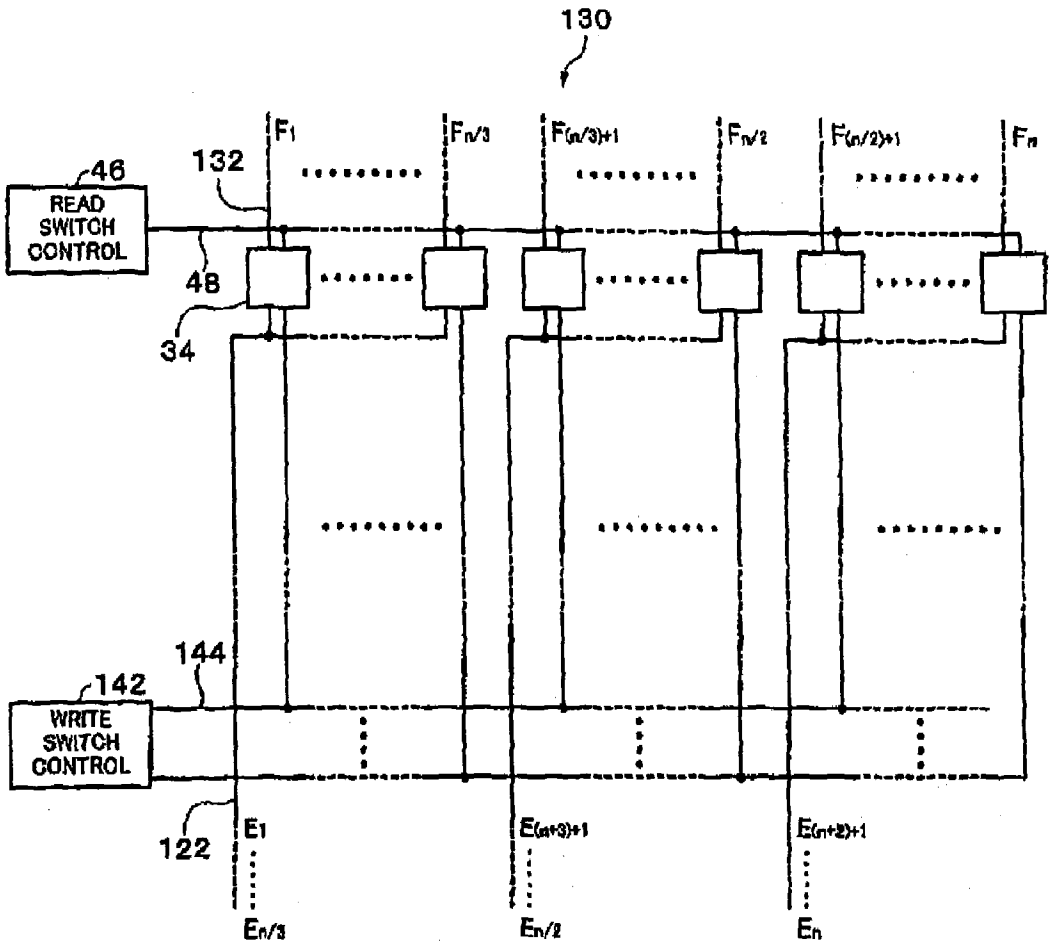
FIG. 9 shows a circuit of the signal transmission device according to the second embodiment of the present invention.

FIGS. 8 and 9 show a circuit of a signal transmission device according to a second embodiment of the present invention. As shown in FIG. 8, the signal transmission device includes a parallel signal output section 110. The parallel signal output section 110 maybe the same as the parallel signal output section 10 in the first embodiment and include the memory 12, the D/A converters 14, and the like. The signal transmission device includes a parallel/serial conversion section 120. As shown in FIG. 9, the signal transmission device includes a serial/parallel conversion section 130.

The parallel signal output section 110 and the parallel/serial conversion section 120 are connected by first parallel transmission lines 116. The parallel/serial conversion section 120 and the serial/parallel conversion section 130 are connected by serial transmission lines 122. Second parallel transmission lines 132 are connected with the serial/parallel conversion section 130.

In the present embodiment, the number of first parallel signals $D_1, \ldots,$ and $D_n$ is n. The number of first parallel transmission lines 116 is n. The number of second parallel transmission lines 132 is n.

The number of serial transmission lines 122 is x. The number of lines of serial signals $E_1, \ldots,$ and $E_n$ is x. In a color display, the first parallel signals $D_1, \ldots,$ and $D_n$ may be converted into three lines of the serial signals $E_1, \ldots,$ and $E_n$ corresponding to the sub pixels of three colors (R, G, and B) , for example. In more detail; one group of the first parallel signals $D_1, \ldots,$ and $D_{n/3}$ may be converted into one line of the serial signals $E_1, \ldots,$ and $E_{n/3}$; one group of the first parallel signals $D_{(n/3)+1}, \ldots,$ and $D_{n/2}$ may be converted into one line of the serial signals $E_{(n/3)+1}, \ldots,$ and $E_{n/3}$; and one group of the first parallel signals $D_{(n/2)+1}, \ldots,$ and $D_n$ maybe converted into one line of the serial signals $E_{(n/2)+1}, \ldots,$ and $E_n$.

In the present embodiment, the number of sampling switching transmission lines 128 connected with a sampling switch control section 126 shown in FIG. 8 is n/x. The number of write switching transmission lines 144 connected with a write switch control section 142 shown in FIG. 9 is n/x.

As shown in FIG. 9, one line of the serial signals $E_1, \ldots,$ and $E_{n/3}$ is converted into one group of second parallel signals $F_1, \ldots,$ and $F_{n/3}$, one line of the serial signals $E_{(n/3)+1}, \ldots,$ and $E_{n/2}$ is converted into one group of second parallel signals $F_{(n/3)+1}, \ldots,$ and $F_{n/2}$, and one line of the serial signals $E_{(n/2)+1}, \ldots,$ and $E_n$ is converted into one group of second parallel signals $F_{(n/2)+1}, \ldots,$ and $F_n$.

Other configurations and operations are the same as those described in the first embodiment. In the present embodiment, the effects described in the first embodiment can also be achieved.

Third Embodiment

Figure 10:
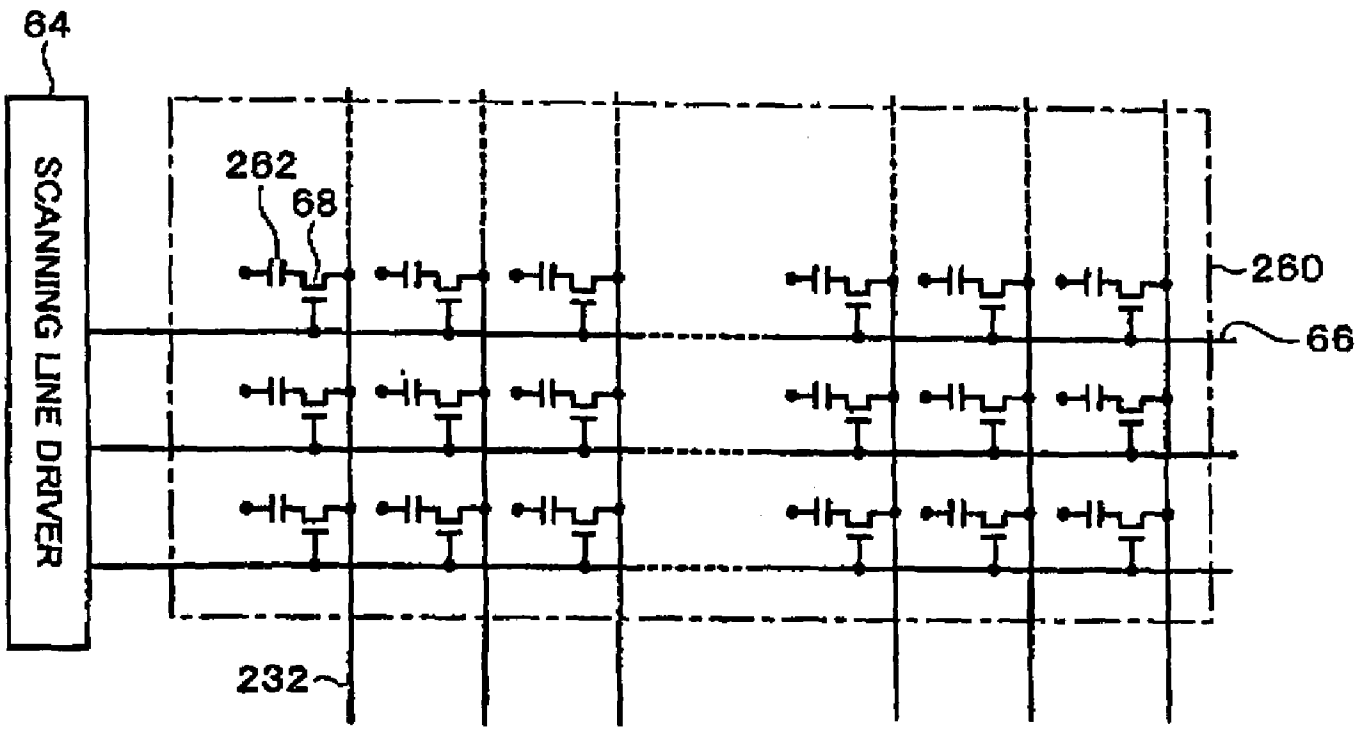
FIG. 10 shows a part of a circuit of an electronic device according to a third embodiment of the present invention.
Figure 11:
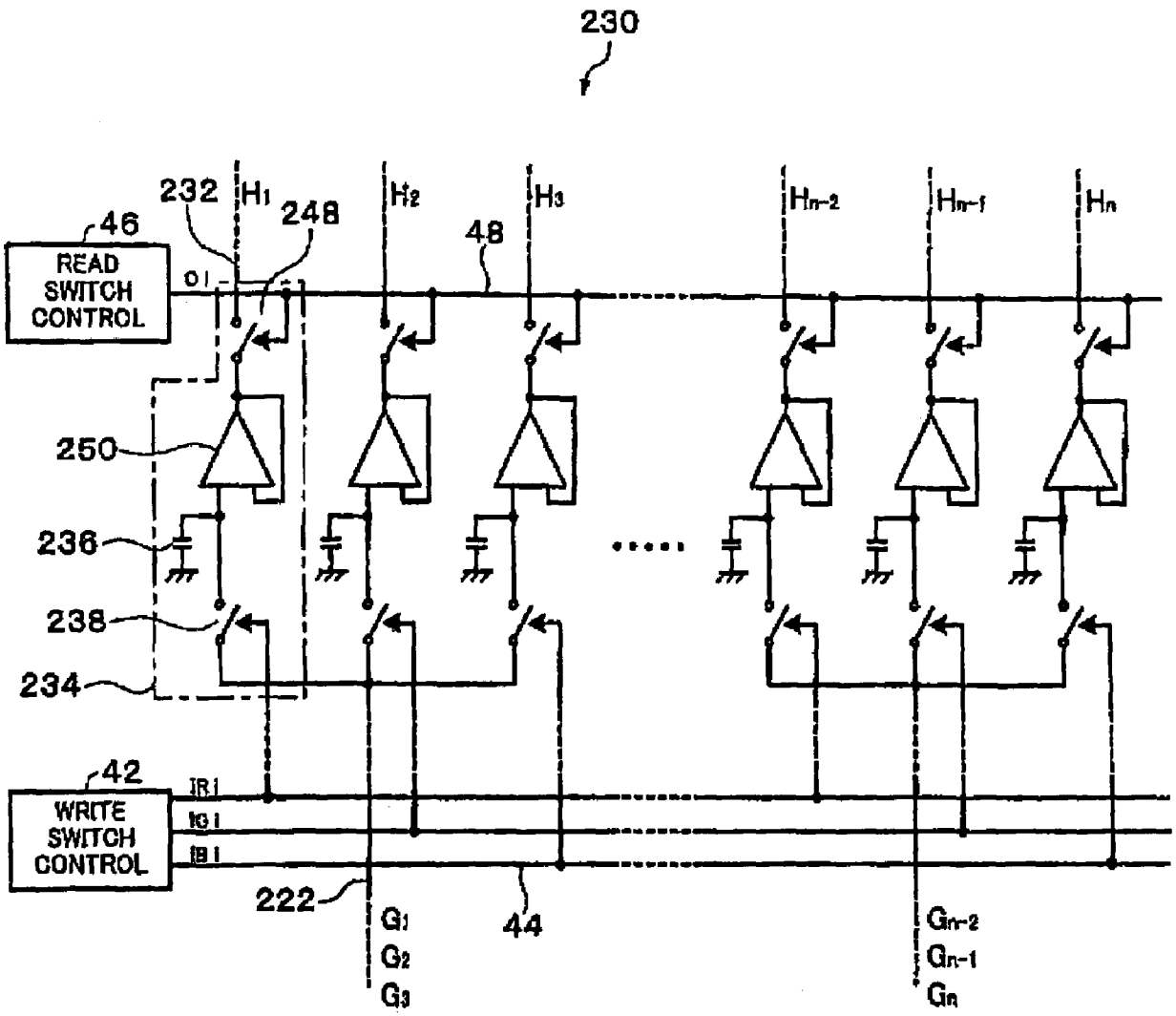
FIG. 11 shows a part of a circuit of a signal transmission device included in the electronic device shown in FIG. 10.

FIG. 10 shows a part of a circuit of an electronic device according to a third embodiment of the present invention. FIG. 11 shows a part of a circuit of a signal transmission device included in the electronic device shown in FIG. 10.

As shown in FIG. 10, the electronic device according to the present embodiment includes a functional section 260. The functional section 260 has a liquid crystal 262. This electronic device is a liquid crystal device (liquid crystal display, liquid crystal projector, or the like). The features of the functional section 60 described in the first embodiment are applicable to the functional section 260 in the present embodiment except for the above feature and changes necessary therefor.

As shown in FIG. 11, the signal transmission device according to the present embodiment includes a serial/parallel conversion section 230. Serial signals $G_1, \ldots,$ and $G_n$ transmitted to serial transmission lines 222 are input to the serial/parallel conversion section 230. In the present embodiment, the serial signals $G_1, \ldots,$ and $G_n$ are voltage signals. Second parallel signals $H_1, \ldots,$ and $H_n$ are transmitted to second parallel transmission lines 232 from the serial/Parallel conversion section 230. The second parallel signals $H_1, \ldots,$ and $H_n$ are voltage signals. Since the voltage signals are output in the present embodiment, the liquid crystal 262 can be driven.

The serial/parallel conversion section 230 includes a plurality of storage sections 234. Each of the storage sections 234 includes a capacitor 236. The capacitor 236 has a first terminal connected with a path which connects one of the serial transmission lines 222 with one of the second parallel transmission lines 232, and a second terminal connected with a constant potential (ground potential, for example). A write switch 238 is provided to a path between the first terminal of the capacitor 236 and one of the serial transmission lines 222. A read switch 248 is provided to a path between the first terminal and one of the second parallel transmission lines 232. A buffer (feedback circuit such as a voltage follower circuit or a amplification circuit) 250 may be connected between the first terminal and the read switch 248.

According to the present embodiment, charges can be stored in the capacitor 236 and the voltage corresponding to the charges can be applied to one of the second parallel transmission lines 232. The features described in the first embodiment are applicable to other configurations and operations. In the present embodiment, the effects described in the first embodiment can also be achieved.

The present embodiment illustrates the liquid crystal display device to which the present invention is applied. However, the features of the present embodiment may be applied to an electronic device which has luminous sections (inorganic EL elements, for example) driven by a voltage instead of the liquid crystal 262. In this case, the buffers 250 may be provided corresponding to each of the luminous sections. In the case where the buffers 250 are amplification circuits, the energy amplification factors (or feed-back characteristics) of the buffers 250 may be set corresponding to the luminous efficiency (ratio of luminous energy (such as brightness) to voltage, for example) of each of the luminous sections. For example, the color balance of the luminous sections can be adjusted by controlling the feed-back characteristics corresponding to R, G, and B.

OTHER EMBODIMENTS

Figure 12:
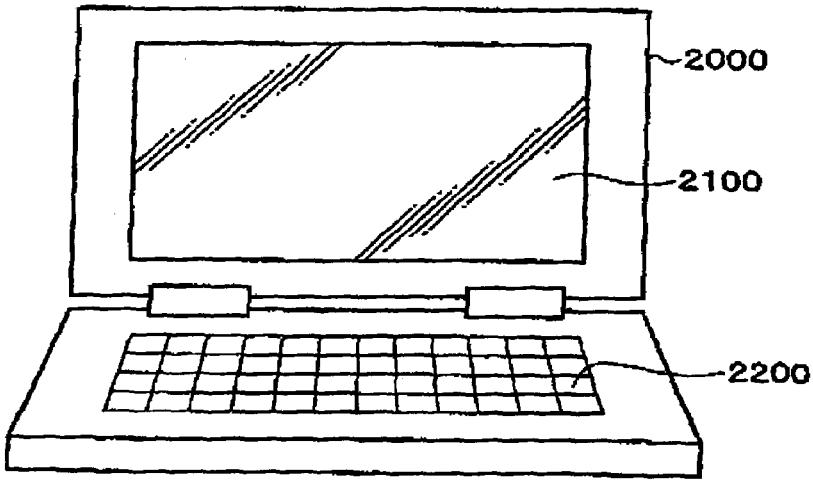
FIG. 12 shows electronic equipment having the electronic device according to the embodiment of the present invention.
Figure 13:
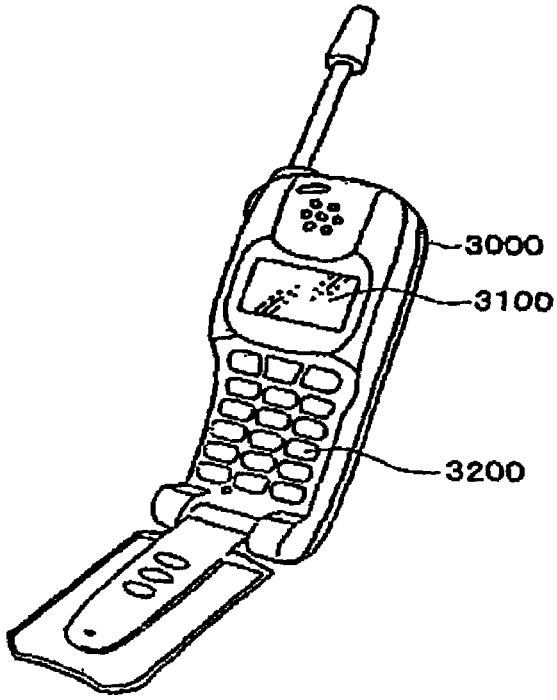
FIG. 13 shows another piece of electronic equipment having the electronic device according to the embodiment of the prevent invention.

FIG. 12 shows a notebook-type personal computer 2000 having the above-described electronic device (display) 2100 and an operating section 2200 of the electronic device as an example of electronic equipment according to the present invention. FIG. 13 shows a portable telephone 3000 having the above-described electronic device (display) 3100 and an operating section 3200 of the electronic device.

The present invention is not limited to the above-described embodiments. Various modifications and variations are possible. For example, the present invention includes configurations essentially the same as the configurations described in the embodiments (for example, configurations having the same function, method, and results, or configurations having the same object and results). The present invention includes configurations in which any unessential part of the configuration described in the embodiments is replaced. The present invention includes configurations having the same effects or achieving the same object as the configurations described in the embodiments. The present invention includes configurations in which conventional technology is added to the configurations described in the embodiments.

What is claimed is:

1. A signal transmission device comprising:

a parallel/serial conversion section which converts a plurality of first parallel signals into at least one line of serial signals, the first parallel signals being output in parallel and in synchronization;

one or more serial transmission lines which transmit the serial signals converted by the parallel/serial conversion section;

a parallel signal output section which outputs the first parallel signals;

a plurality of first parallel transmission lines which transmit the first parallel signals;

a serial/parallel conversion section which converts the serial signals into a plurality of second parallel signals; and a plurality of second parallel transmission lines which transmit the second parallel signals, wherein the parallel signal output section, the first parallel transmission lines, and the parallel/serial conversion section are provided to a first component, wherein the serial/parallel conversion section and the second parallel transmission lines are provided to a second component, and wherein each of the serial transmission lines has a first transmission section provided to the first component and a second transmission section provided to the second component, the first transmission section and the second transmission section being connected.

2. The signal transmission device as defined in claim 1, wherein the serial signals are output as current signals.

3. The signal transmission device as defined in claim 1, wherein the first parallel signals are transmitted in parallel through n lines, wherein the number of the first parallel transmission lines is n, wherein the serial signals are successively transmitted in series in a unit of m per line, wherein the serial signals are transmitted in series separately through n/m lines, wherein the number of the serial transmission lines is n/m, and wherein the number of the second parallel transmission lines is n.

4. The signal transmission device as defined claim 1, wherein the first parallel signals are transmitted in parallel through n lines, wherein the number of the first parallel transmission lines is n, wherein the serial signals are transmitted in series separately through x lines, wherein the number of the serial transmission lines is x, and wherein the number of the second parallel transmission lines is n.

5. The signal transmission device as defined in claim 1, wherein the first parallel signals are analog signals.

6. The signal transmission device as defined in claim 3, wherein the parallel/serial conversion section includes a sampling switch which switches connection between one group of transmission lines among the first parallel transmission lines and one of the serial transmission lines.

7. The signal transmission device as defined in claim 6, wherein a plurality of the sampling switches are provided, and wherein each of the sampling switches is provided to a path between one transmission line of the one group of the first transmission lines and one of the serial transmission lines.

8. The signal transmission device as defined in claim 7, wherein the parallel/serial conversion section further includes a sampling switch control section which controls the sampling switches so that the sampling switches are successively turned on.

9. The signal transmission device as defined in claim 8, wherein the parallel/serial conversion section further includes a plurality of sampling switching transmission lines which connect the sampling switch control section with control terminals of the sampling switches, and wherein the sampling switch control section successively transmits sampling switching signals to the sampling switching transmission lines.

10. The signal transmission device as defined in claim 9, wherein the number of the sampling switching transmission lines is m.

11. The signal transmission device as defined in claim 4, wherein the parallel/serial conversion section includes a sampling switch which switches connection between one group of transmission lines among the first parallel transmission lines and one of the serial transmission lines.

12. The signal transmission device as defined in claim 11, wherein a plurality of the sampling switches are provided, and wherein each of the sampling switches is provided to a path between one transmission line of the one group of the first transmission lines and one of the serial transmission lines.

13. The signal transmission device as defined in claim 12, wherein the parallel/serial conversion section further includes a sampling switch control section which controls the sampling switches so that the sampling switches are successively turned on.

14. The signal transmission device as defined in claim 13, wherein the parallel/serial conversion section further includes a plurality of sampling switching transmission lines which connect the sampling switch control section with control terminals of the sampling switches, and wherein the sampling switch control section successively transmits sampling switching signals to the sampling switching transmission lines.

15. The signal transmission device as defined in claim 14, wherein the number of the sampling switching transmission lines is n/x.

16. The signal transmission device as defined in claim 3, wherein the serial/parallel conversion section includes a plurality of storage sections, each of the storage sections storing information corresponding to one of the serial signals.

17. The signal transmission device as defined in claim 16, wherein each of the storage sections includes a storage medium which stores the information, a write switch for writing the information in the storage medium, and a read switch for reading the information from the storage medium.

18. The signal transmission device as defined in claim 17, wherein the serial/parallel conversion section further includes a write switch control section which controls the write switches in one group of storage sections among the storage sections so that the write switches are successively turned on.

19. The signal transmission device as defined in claim 18, wherein the serial/parallel conversion section further includes a plurality of write switching transmission lines which connect the write switch control section with control terminals of the write switches, and wherein the write switch control section successively transmits write switching signals to the write switching transmission lines.

20. The signal transmission device as defined in claim 19, wherein the number of the write switching transmission lines is m.

21. The signal transmission device as defined in claim 4, wherein the serial/parallel conversion section includes a plurality of storage sections, each of the storage sections storing information corresponding to one of the serial signals.

22. The signal transmission device as defined in claim 21, wherein each of the storage sections includes a storage medium which stores the information, a write switch for writing the information in the storage medium, and a read switch for reading the information from the storage medium.

23. The signal transmission device as defined in claim 22, wherein the serial/parallel conversion section further includes a write switch control section which controls the write switches in one group of storage sections among the storage sections so that the write switches are successively turned on.

24. The signal transmission device as defined in claim 23, wherein the serial/parallel conversion section further includes a plurality of write switching transmission lines which connect the write switch control section with control terminals of the write switches, and wherein the write switch control section successively transmits write switching signals to the write switching transmission lines.

25. The signal transmission device as defined in claim 24, wherein the number of the write switching transmission lines is n/x.

26. The signal transmission device as defined in claim 17, wherein the storage medium is a capacitor and holds charges as the information.

27. The signal transmission device as defined in claim 26, wherein each of the second parallel signals is a current signal.

28. A signal transmission device comprising:

a parallel/serial conversion section which converts a plurality of first parallel signals into at least one line of serial signals, the first parallel signals being output in parallel and in synchronization;

one or more serial transmission lines which transmit the serial signals converted by the parallel/serial conversion section;

a parallel signal output section which outputs the first parallel signals;

a plurality of first parallel transmission lines which transmit the first parallel signals;

a serial/parallel conversion section which converts the serial signals into a plurality of second parallel signals; and a plurality of second parallel transmission lines which transmit the second parallel signals, wherein the parallel signal output section, the first parallel transmission lines, and the parallel/serial conversion section are provided to a first component, wherein the first parallel signals are transmitted in parallel through n lines, wherein the number of the first parallel transmission lines is n, wherein the serial signals are successively transmitted in series in a unit of m per line, wherein the serial signals are transmitted in series separately through n/m lines, wherein the number of the serial transmission lines is n/m, and wherein the number of the second parallel transmission lines is n, wherein the serial/parallel conversion section includes a plurality of storage sections, each of the storage sections storing information corresponding to one of the serial signals, wherein each of the storage sections includes a storage medium which stores the information, a write switch for writing the information in the storage medium, and a read switch for reading the information from the storage medium, wherein the storage medium is a capacitor and holds charges as the information, wherein each of the second parallel signals is a current signal, wherein each of the storage sections includes first and second transistors, wherein each of the first and second transistors has first, second, and third terminals, wherein current flowing between the first and second terminals is controlled by voltage applied between the first and third terminals, wherein the first terminal of the first transistor and the first terminal of the second transistor are connected, and the third terminal of the first transistor and the third terminal of the second transistor are connected, wherein the second and third terminals of the first transistor are connected, wherein one of the serial transmission lines is connected with the second terminal of the first transistor, wherein one of the second parallel transmission lines is connected with the second terminal of the second transistor, and wherein the capacitor is connected between the third terminal and the first terminal.

29. The signal transmission device as defined in claim 28, wherein the write switch performs on/off operations of first and second paths, wherein the first path is provided between the second terminal of the first transistor and one of the serial transmission lines, and wherein the second path is a path which branches from a path between the first path and the second terminal of the first transistor and reaches the third terminal.

30. The signal transmission device as defined in claim 28, wherein the first and second transistors are field effect transistors, the first and second terminals are source and drain terminals, and the third terminals are gate terminals.

31. The signal transmission device as defined in claim 28, wherein a gain of the first transistor is equal to a gain of the second transistor in at least one of the storage sections, and wherein a signal input to the at least one storage section is equal in size to a signal output from the at least one storage section.

32. The signal transmission device as defined in claim 28, wherein a gain of the first transistor differs from a gain of the second transistor in at least one of the storage sections, and wherein a signal input to the at least one storage section differs in size from a signal output from the at least one storage section.

33. The signal transmission device as defined in claim 26, wherein the serial signals are output as voltage signals, and wherein each of the second parallel signals is a voltage signal.

34. The signal transmission device as defined in claim 33, wherein the capacitor has a first terminal connected with a path which connects one of the serial transmission lines with one of the second parallel transmission lines, and a second terminal connected with a constant potential, wherein the write switch is provided to a path between the first terminal and one of the serial transmission lines, and wherein the read switch is provided to a path between the first terminal and one of the second parallel transmission lines.

35. The signal transmission device as defined in claim 34, further comprising:

a buffer connected between the first terminal and the read switch.

36. An electronic device comprising:

a signal transmission device; and a functional section, wherein the signal transmission device includes:

a parallel/serial conversion section which converts a plurality of first parallel signals into at least one line of serial signals, the first parallel signals being output in parallel and in synchronization;

one or more serial transmission lines which transmit the serial signals converted by the parallel/serial conversion section;

a parallel signal output section which outputs the first parallel signals;

a plurality of first parallel transmission lines which transmit the first parallel signals;

a serial/parallel conversion section which converts the serial signals into a plurality of second parallel signals; and a plurality of second parallel transmission lines which transmit the second parallel signals, wherein the parallel signal output section, the first parallel transmission lines, and the parallel/serial conversion section are provided to a first component, wherein the serial/parallel conversion section and the second parallel transmission lines are provided to a second component, wherein the functional section is provided to the second component, wherein the functional section is operated according to the first parallel signals, wherein each of the serial transmission lines has a first transmission section provided to the first component and a second transmission section provided to the second component, the first transmission section and the second transmission section being connected.

37. The electronic device as defined in claim 36, wherein the functional section is a display section, and wherein the second parallel transmission lines are data lines.

38. The electronic device as defined in claim 37, wherein the functional section includes a plurality of luminous sections.

39. An electronic device comprising:

a signal transmission device; and a functional section, wherein the signal transmission device includes:

a parallel/serial conversion section which converts a plurality of first parallel signals into at least one line of serial signals, the first parallel signals being output in parallel and in synchronization;

one or more serial transmission lines which transmit the serial signals converted by the parallel/serial conversion section;

a parallel signal output section which outputs the first parallel signals;

a plurality of first parallel transmission lines which transmit the first parallel signals;

a serial/parallel conversion section which converts the serial signals into a plurality of second parallel signals; and a plurality of second parallel transmission lines which transmit the second parallel signals, wherein the parallel signal output section, the first parallel transmission lines, and the parallel/serial conversion section are provided to a first component, wherein the serial/parallel conversion section and the second parallel transmission lines are provided to a second component, wherein the functional section is provided to the second component, and wherein the functional section is operated according to the first parallel signals, wherein the functional section is a display section, and wherein the second parallel transmission lines are data lines, wherein the functional section includes a plurality of luminous sections, wherein the serial/parallel conversion section includes a plurality of storage sections, each of the storage sections storing information corresponding to one of the serial signals, wherein each of the storage sections includes a storage medium which stores the information, a write switch for writing the information in the storage medium, and a read switch for reading the information from the storage medium, wherein the storage medium is a capacitor and holds charges as the information, wherein each of the second parallel signals is a current signal, wherein each of the storage sections includes first and second transistors, wherein each of the first and second transistors has first, second, and third terminals, wherein current flowing between the first and second terminals is controlled by voltage applied between the first and third terminals, wherein the first terminal of the first transistor and the first terminal of the second transistor are connected, and the third terminal of the first transistor and the third terminal of the second transistor are connected, wherein the second and third terminals of the first transistor are connected, wherein one of the serial transmission lines is connected with the second terminal of the first transistor, wherein one of the second parallel transmission lines is connected with the second terminal of the second transistor, wherein the capacitor is connected between the third terminal and the first terminal, wherein a gain of the first transistor differs from a gain of the second transistor in at least one of the storage sections, wherein a signal input to the at least one storage section differs in size from a signal output from the at least one storage section, wherein the luminous sections emit light of a plurality of colors, each of the luminous sections emitting light of one of the colors, wherein one of the luminous sections of one color differs in luminous efficiency from another of the luminous sections of another color, wherein each of the storage sections is provided corresponding to the luminous sections of respective colors, and wherein a gain ratio of the first and second transistors in each of the storage sections is set corresponding to the luminous efficiency.

40. The electronic device as defined in claim 39, wherein the gain ratio of the first and second transistors is one in one of the storage sections corresponding to one of the luminous sections of one of the colors, and wherein the gain ratio of the first and second transistors is set to other than one in the other storage sections corresponding to the luminous sections of the other two or more colors.

41. The electronic device as defined in claim 38, further comprising:

a buffer connected between the first terminal and the read switch, wherein the serial/parallel conversion section includes a plurality of storage sections, each of the storage sections storing information corresponding to one of the serial signals, wherein each of the storage sections includes a storage medium which stores the information, a write switch for writing the information in the storage medium, and a read switch for reading the information from the storage medium, wherein the storage medium is a capacitor and holds charges as the information, wherein the serial signals are output as voltage signals, wherein each of the second parallel signals is a voltage signal, wherein the capacitor has a first terminal connected with a path which connects one of the serial transmission lines with one of the second parallel transmission lines, and a second terminal connected with a constant potential, wherein the write switch is provided to a path between the first terminal and one of the serial transmission lines, wherein the read switch is provided to a path between the first terminal and one of the second parallel transmission lines, wherein the luminous sections emit light of a plurality of colors, each of the luminous sections emitting light of one of the colors, wherein one of the luminous sections of one color differs in luminous efficiency from another of the luminous sections of another color, wherein the buffer is provided corresponding to each of the luminous sections of respective colors, and wherein an energy amplification factor of the buffer is set corresponding to the luminous efficiency.

42. The electronic device as defined in claim 36, wherein a liquid crystal is provided to the functional section.

43. Electronic equipment comprising:

an electronic device which includes a signal transmission device and a functional section; and an operating section of the electronic device, wherein the signal transmission device includes:

a parallel/serial conversion section which converts a plurality of first parallel signals into at least one line of serial signals, the first parallel signals being output in parallel and in synchronization;

one or more serial transmission lines which transmit the serial signals converted by the parallel/serial conversion section;

a parallel signal output section which outputs the first parallel signals;

a plurality of first parallel transmission lines which transmit the first parallel signals;

a serial/parallel conversion section which converts the serial signals into a plurality of second parallel signals; and a plurality of second parallel transmission lines which transmit the second parallel signals, wherein the parallel signal output section, the first parallel transmission lines, and the parallel/serial conversion section are provided to a first component, wherein the serial/parallel conversion section and the second parallel transmission lines are provided to a second component, wherein the functional section is provided to the second component, wherein the functional section is operated according to the first parallel signals, and wherein each of the serial transmission lines has a first transmission section provided to the first component and a second transmission section provided to the second component, the first transmission section and the second transmission section being connected.

44. A signal transmission method comprising:

(a) outputting a plurality of first parallel signals in parallel and in synchronization from a parallel signal output section, and transmitting the first parallel signals to a plurality of first parallel transmission lines;

(b) converting the first parallel signals into at least one line of serial signals by a parallel/serial conversion section, and transmitting the serial signals to one or more serial transmission lines; and (c) converting the serial signals into a plurality of second parallel signals by a serial/parallel conversion section, and transmitting the second parallel signals to a plurality of second parallel transmission lines, wherein the parallel signal output section, the first parallel transmission lines, and the parallel/serial conversion section are provided to a first component, wherein the serial/parallel conversion section and the second parallel transmission lines are provided to a second component, and wherein each of the serial transmission lines has a first transmission section provided to the first component and a second transmission section provided to the second component, the first transmission section and the second transmission section being connected.

45. The signal transmission method as defined in claim 44, wherein, in the step (b), connection between one group of transmission lines among the first parallel transmission lines and one of the serial transmission lines is switched by a sampling switch.

46. The signal transmission method as defined in claim 45, wherein a plurality of the sampling switches are provided, wherein each of the sampling switches is provided to a path between one transmission line of the one group of the first transmission lines and one of the serial transmission lines, and wherein, in the step (b), the sampling switches are controlled by a sampling switch control section so that the sampling switches are successively turned on.

47. The signal transmission method as defined in claim 46, wherein the parallel/serial conversion section further includes a plurality of sampling switching transmission lines which connect the sampling switch control section with control terminals of the sampling switches, and wherein, in the step (b), sampling switching signals are successively transmitted to the sampling switching transmission lines by the sampling switch control section.

48. The signal transmission method as defined in claim 44, wherein the serial/parallel conversion section includes a plurality of storage sections, and wherein, in the step (c), information corresponding to one of the serial signals is stored in each of the storage sections.

49. The signal transmission method as defined in claim 48, wherein each of the storage sections includes a storage medium which stores the information, a write switch for writing the information in the storage medium, and a read switch for reading the information from the storage medium, and wherein, in the step (c), the write switches in one group of storage sections among the storage sections are controlled by a write switch control section so that the write switches are successively turned on.

50. The signal transmission method as defined in claim 49, wherein the serial/parallel conversion section further includes a plurality of write switching transmission lines which connect the write switch control section with control terminals of the write switches, and wherein, in the step (c), write switching signals are successively transmitted to the write switching transmission lines by the write switch control section.

51. The signal transmission method as defined in claim 49, wherein the storage medium is a capacitor, wherein each of the storage sections includes first and second transistors, and wherein, in the step (c), current is caused to flow through one of the second parallel transmission lines by storing charges corresponding to a control voltage of current flowing through the first transistor in the capacitor, and controlling the second transistor by voltage corresponding to the charges.

52. The signal transmission method as defined in claim 51, wherein a gain of the first transistor is equal to a gain of the second transistor in at least one of the storage sections, and wherein current which is equal in size to current input to the at least one storage section is output in the step (c).

53. The signal transmission method as defined in claim 51, wherein a gain of the first transistor differs from a gain of the second transistor in at least one of the storage sections, and wherein current which differs in size from current input to the at least one storage section is output in the step (c).

54. The signal transmission method as defined in claim 49, wherein the storage medium is a capacitor, and wherein, in the step (c), charges are stored in the capacitor and voltage corresponding to the charges is applied to one of the second parallel transmission lines.

* * * * *